US009545659B2

(12) United States Patent
Hay et al.

(10) Patent No.: US 9,545,659 B2
(45) Date of Patent: Jan. 17, 2017

(54) POPPET PIN EJECTOR

(71) Applicant: National Machinery LLC, Tiffin, OH (US)

(72) Inventors: Thomas E. Hay, Tiffin, OH (US); Jeffrey W. Carper, Tiffin, OH (US)

(73) Assignee: NATIONAL MACHINERY LLC, Tiffin, OH (US)

( * ) Notice: Subject to any disclaimer, the term of this patent is extended or adjusted under 35 U.S.C. 154(b) by 29 days.

(21) Appl. No.: 14/625,671

(22) Filed: Feb. 19, 2015

(65) Prior Publication Data

US 2016/0243608 A1 Aug. 25, 2016

(51) Int. Cl.
*B21J 9/02* (2006.01)
*B21J 13/14* (2006.01)

(52) U.S. Cl.
CPC ..... *B21J 13/14* (2013.01); *B21J 9/022* (2013.01)

(58) Field of Classification Search
CPC ..... B21J 13/14; B21J 5/02; B21J 9/022; B21J 13/02; B21D 45/00; B21D 45/02; B21D 45/04; B21D 45/06; B21D 45/10
See application file for complete search history.

(56) References Cited

U.S. PATENT DOCUMENTS 3,748,887 A * 7/1973 Widera ..... B21D 45/02 72/345
6,189,362 B1 2/2001 Nagao et al.
7,377,042 B2 5/2008 Krintzline et al.

* cited by examiner

*Primary Examiner* — Debra Sullivan
(74) *Attorney, Agent, or Firm* — Pearne & Gordon LLP

(57) ABSTRACT

A tool for a progressive forming machine comprising an assembly having a workpiece shaping cavity symmetrical about an axis and including an end wall transverse to the axis, a conical bore open to the end wall and centered on the axis, the sides of the conical bore being described by a relatively small angle relative to the axis, and an ejector pin for forcing workpieces form the cavity, the ejector pin having an end face and a conical body portion rearward of the end face, the conical body portion having an external surface matching a surface of the conical bore.

6 Claims, 2 Drawing Sheets

POPPET PIN EJECTOR

BACKGROUND OF THE INVENTION

The invention relates to tooling for cold forming metal parts and, more specifically, to improvements in ejector pins for tool cavities.

PRIOR ART

High speed progressive formers typically convert a blank or workpiece, starting as a sheared length of wire, into a part of complex shape. The shaping process involves transfer of the workpiece between progressive workstations. At a typical workstation, the workpiece is struck by a tool on a reciprocating ram while it is positioned at a stationary tool on a bolster. Where a tool is in the form of a cavity, an ejector pin is used to ensure that the workpiece is pushed free of the cavity after it has been shaped in the cavity.

Conventionally, an ejector pin is a cylindrical element with a flat end that forms part of the cavity wall during the forming blow and thereafter is forced into the cavity to positively displace the workpiece. A problem associated with a conventional ejector pin is the tendency of the pin to compress longitudinally or axially when subjected to the high forming forces on the workpiece. Displacement of the pin face is typically reflected as an unintended step in the surface of the workpiece. Abrupt changes in the workpiece surface contour are visually objectionable and can lead to defective finished parts. A prior attempt to eliminate variation in the position of the ejector pin face involved making the pin end with a relatively high taper angle that when seated was coincident with the angle of the adjacent cavity wall area. This approach, while affording some benefit in reducing displacement of the pin end face under compression, introduced other problems. The pin was susceptible to breakage and venting flats on the pin head periphery complicated replacement efforts due to irregular wear patterns on the insert forming the main part of the cavity. The juncture of the pin perimeter and remainder of the cavity wall was at a location where material flow of the workpiece was prone to produce a flash on the workpiece and high stress on the pin edge.

SUMMARY OF THE INVENTION

The invention provides an ejector pin arrangement that greatly reduces the tendency of the pin to recede into the cavity forming tool body or insert when subjected to forming pressures on a workpiece. The ejector pin is characterized by a narrowly tapered profile that reduces in diameter from a workpiece contacting end face. The ejector pin is received in a complementarily shaped bore in the tool insert. The pin and insert bore are dimensioned with a fit that locks the pin against axial movement from where the pin end face is at a desired position relative to adjacent surfaces of the cavity. Normally, the disposition is where the pin end face matches up smoothly with surrounding surface areas of the tool insert cavity.

Since the pin is friction-gripped in the insert bore adjacent the pin end face, there is minimal compression of the pin relative to the insert from forming pressure in a workpiece. Consequently, little or no fitting of a pin is required to obtain a well formed workpiece free of surface defects.

Typically, a tool cavity is configured with a seating area, sometimes known as the "crotch" where a workpiece being received in the tool first becomes seated and stabilized before the actual forming blow occurs. Preferably, the pin end face of the invention is situated radially inward of this workpiece seating area.

DESCRIPTION OF THE PREFERRED EMBODIMENT

A tool set 10 shown in the figures is adapted to be used in a progressive cold forming or forging machine such as shown and described, for example, in U.S. Pat. No. 7,377,042. In the illustrated arrangement, the tool set 10 is adapted to be used at the first working station in the machine where a metal workpiece or blank 24 is received after being sheared from a supply of wire at a cut-off station of the machine.

Figure 1:
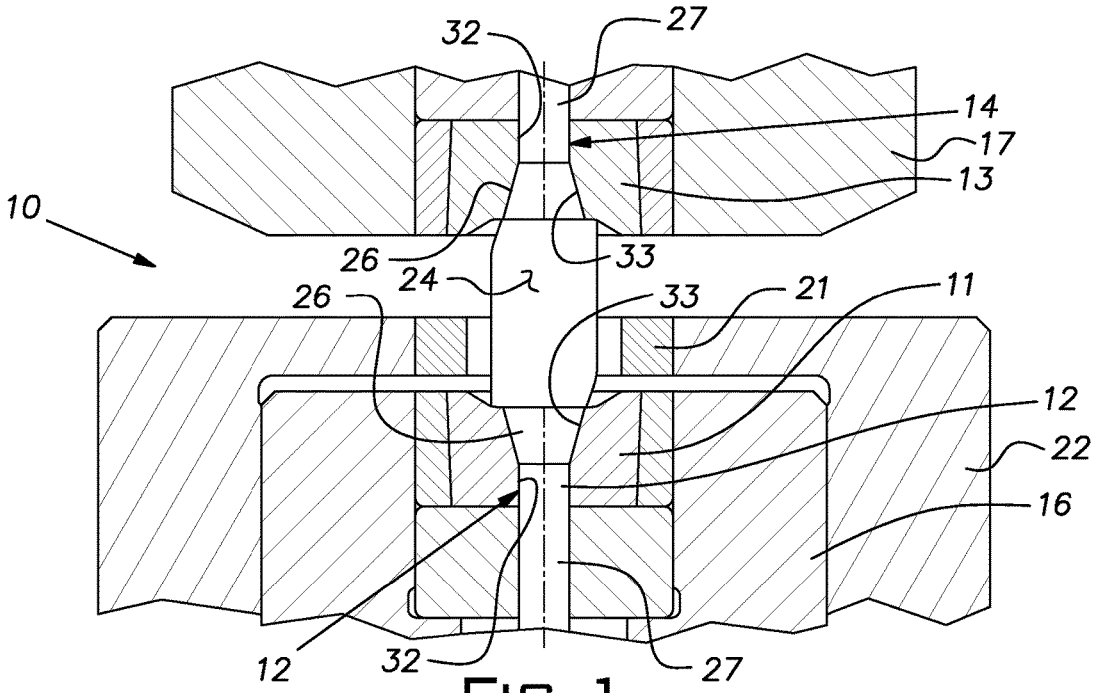
FIG. 1 is a cross-sectional view of a pair of opposed tool sets in a workstation of a progressive forming machine showing a workpiece prior to forming at the station.
Figure 2:
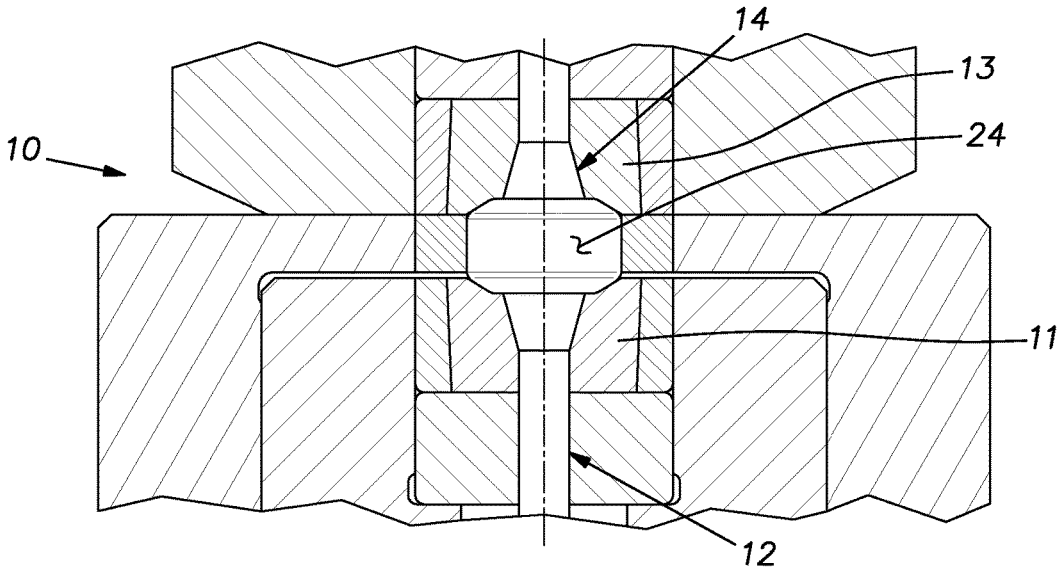
FIG. 2 is a view like FIG. 1 showing the workpiece at the completion of a forming blow.

Tooling parts 11, 12 on the lower area of FIGS. 1 and 2 are mounted on the bolster of the forming machine. The parts include a cavity insert 11 and an ejector pin 12. Tooling parts 13, 14 on the upper area of FIGS. 1 and 2 are mounted on the moveable ram or slide of the former machine so that they move cyclically towards and away from the bolster. The slide mounted parts include a cavity insert 13 and ejector pin 14. Conventionally, these tooling parts are circular elements and may be made of carbide or other suitably hard material. In the illustrated arrangement, the parts 11 and 13 are inserts carried in respective cases 16, 17.

A tool insert 21 is of a sliding ring-type disclosed in aforementioned U.S. Pat. No. 7,377,042. The sliding ring insert 21 is carried in a cylindrical tubular case 22 slidably mounted on the bolster and capable of moving axially a limited distance parallel to the direction of movement of the slide or ram. The case 22, and therefore the insert 21, are biased towards the ram by springs.

In the illustrated arrangement, the bolster and ram tools 11-14 are substantially of the same configuration so as to form the same shape on each end face of the workpiece 24. Each ejector pin 12, 14 is concentric with the axis of the respective insert 11, 13. The ejector pins 12, 14 have a geometry analogous to a poppet valve, having a conical head 26 and a cylindrical stem 27. The peripheries of the heads 26 and stems 27 are preferably smooth and uninterrupted by slots or grooves. In the illustrated example, the sides of the head 26 diverge at an angle of 15 degrees from an axis 15 of the pin 12, 14. The angle of the side is less than 30 degrees preferably ranges from a minimum of 7 degrees and a maximum of less than 30 degrees. The pin axis is coincident with the axis of the workstation.

Figure 3:
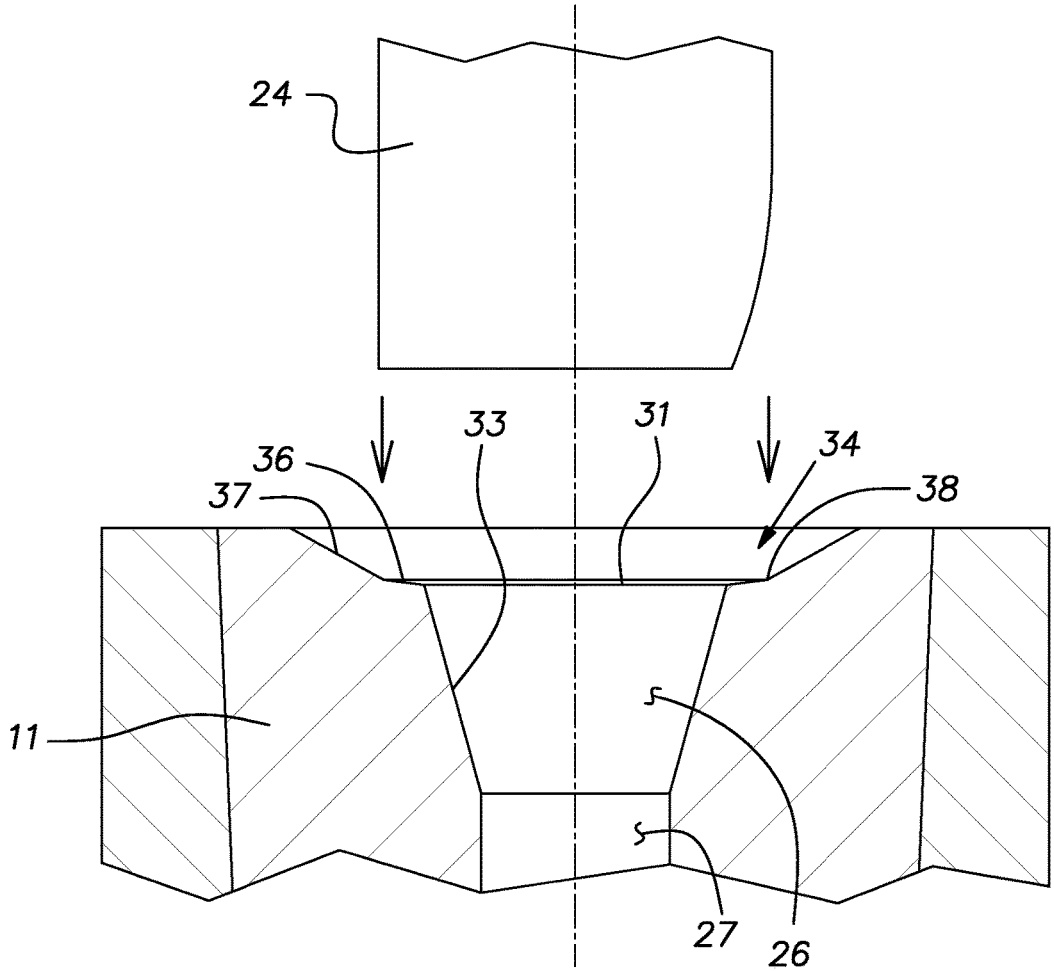
FIG. 3 is a cross-sectional view of a typical tool cavity area on an enlarged scale and schematically illustrating radial alignment of the workpiece to the tool cavity.

In the illustrated case, the pin 12, 14 has a flat, circular end face perpendicular to the axis 15. If desired, the pin end face 31 can have a shallow crown or depression, for example, with a cone angle of between about 3 degrees and about 10 degrees. A central bore 32 in the insert 11, 13, aligned with the axis 15, provides a sliding fit with the outside diameter of the pin stem 27. A conical bore 33 at the outward side of a respective insert 11, 13 has the same angle as its associated ejector pin head 26. The conical bore 33 is proportioned relative to the pin head 26 such that when the head is seated in the conical bore 33, the peripheral edge of the pin end face 31 is flush with the surface of a cavity 34 in an insert 11, 13 in an area forming the mouth of the conical bore (FIG. 3). The peripheral edges of the pin head 26 and mouth of the bore 33, ideally, are relatively sharp, but can be broken or rounded as desired or necessary.

Outer opposed faces of the tooling inserts 11, 13 are centrally dished to form respective workpiece receiving cavities 34. FIG. 3 illustrates an insert cavity on an enlarged scale. The contour of the cavities 34 includes an inner annular zone 36 extending outwardly from the mouth of the tapered bore 33 and a concentric outer annular zone 37 having a slope angle greater than that of the inner zone 36 and less than 59 degrees.

Desirably, an intersection 38 of the inner and outer cavity zones 36, 37 is situated so that it is approximately at the diameter of a workpiece 24 as it is delivered to the respective workstation. The intersection 38 forms a "crotch" or socket for the end of the workpiece 24 serving to center and stabilize the workpiece. Here, as shown, the inner zone 36 has a positive slope, its inner edge and the edge of the pin head are protected from extreme conditions imposed by a forming blow on the workpiece 24.

The ring insert 21 is biased by springs towards the slide to the position illustrated in FIG. 1. The interior of the sliding ring insert 21 serves as part of the tooling cavity both for the bolster and for the slide. The sliding ring insert 21 which has an inside diameter larger than the cavity 34 improves the fill of the bolster tooling cavity by preventing friction forces from restraining material flow into the bottom areas of the cavity. This sliding ring function facilitates processes such as where the workpiece is a net-shaped product.

The poppet-shaped ejector pin 12, 14 eliminates problems associated with compression of a conventional ejector pin along its full length that results in displacement of the end face of the pin and a mismatch of its surface and the surrounding surface of the respective cavity. Displacement of the end face will result in an objectionable stepped face on the workpiece that can produce defective parts. When the pin head 26 is fully received in the conical bore 33, there being no vent grooves along their interface, liquid lubricant or coolant cannot pass through their interface, i.e. the surfaces of these parts form a fluid tight joint. Lubricating oil or coolant trapped at any crevice between the peripheries of the head end face 31 and inner cavity surface zone 36, due to any slight chamfer, for example, will exclude flash from the workpiece developing into the crevice. While the ejector pin 12, 14 of the invention is illustrated with substantially identical tool cavities on the bolster and slide, the pin can be used with tools of different configuration and can be used on only one of the bolster and ram.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A tool for a progressive forming machine comprising an assembly having a workpiece shaping cavity symmetrical about an axis and including an end wall transverse to the axis, the end wall having a slope change in a zone symmetrical about the axis forming a centering and stabilizing pocket for a workpiece, a conical bore open to the end wall and centered on the axis, and an ejector pin for forcing workpieces from the cavity, the ejector pin having an end face and a conical body portion rearward of the end face, the conical body portion having an external surface matching a surface of the conical bore, a mouth of the bore and end face of the ejector pin being spaced radially inwardly from the pocket, the end wall having inner and outer circular areas of different positive slopes forming the pocket, the inner area being closer to a plane perpendicular to the axis than the outer area, the inner area being concave.

2. A tool as set forth in claim 1, wherein the inner area is described by an angle of about 7 degrees from a plane perpendicular to the axis.

3. A tool for a progressive forming machine comprising an assembly having a workpiece shaping cavity symmetrical about an axis and including an end wall transverse to the axis, a conical bore open to the end wall and centered on the axis, sides of the conical bore being described by a positive angle relative to the axis of less than 30 degrees, and an ejector pin for forcing workpieces from the cavity, the ejector pin having an end face and a conical body portion rearward of the end face, the entire end face having a relatively flat surface within 10° of a plane perpendicular to the axis, the conical body portion having an external surface matching a surface of the conical bore.

4. A tool as set forth in claim 3, wherein the conical bore surface and the conical body portion are devoid of grooves whereby they are capable of establishing a fluid tight seal therebetween when forced together.

5. A tool for a progressive former comprising an assembly having a workpiece shaping cavity symmetrical about an axis and including an end wall transverse to the axis, a conical bore open to the end wall and centered on the axis, the conical bore being described by a positive angle relative to the axis of less than 30 degrees, and an ejector pin for forcing workpieces from the cavity, the ejector pin having an end face and a conical body portion rearward of the end face, the entire end face having a relatively flat surface within 10° of a plane perpendicular to the axis, the conical body portion having an external surface matching a surface of the conical bore, a sliding ring guided by a case circumferentially surrounding the cavity concentric with the axis having an inside diameter larger than the end wall adapted to confine material of a workpiece while moving with the material towards the end wall.

6. A tool for a progressive former comprising an assembly having a workpiece shaping cavity symmetrical about an axis and including an end wall transverse to the axis, a conical bore open to the end wall and centered on the axis, and an ejector pin for forcing workpieces from the cavity, the ejector pin having an end face and a conical body portion rearward of the end face, the conical body portion having an external surface matching a surface of the conical bore, the end wall adjacent the conical bore having a positive slope angle from a plane perpendicular to the axis of less than 59 degrees.

* * * * *